US008781379B2

(12) United States Patent
Oishi et al.

(10) Patent No.: US 8,781,379 B2
(45) Date of Patent: Jul. 15, 2014

(54) FUSING DEVICE, PRINT DEVICE AND APPARATUS FOR HEATING BELT

(75) Inventors: Noboru Oishi, Tokyo (JP); Teruo Soeda, Tokyo (JP)

(73) Assignee: Oki Data Corporation, Tokyo (JP)

( * ) Notice: Subject to any disclaimer, the term of this patent is extended or adjusted under 35 U.S.C. 154(b) by 177 days.

(21) Appl. No.: 13/118,817

(22) Filed: May 31, 2011

(65) Prior Publication Data

US 2011/0299904 A1 Dec. 8, 2011

(30) Foreign Application Priority Data

Jun. 4, 2010 (JP) ..... 2010-129434

(51) Int. Cl.
*G03G 15/20* (2006.01)

(52) U.S. Cl.
USPC ..... 399/329

(58) Field of Classification Search
USPC ..... 399/329, 328, 122, 335, 338; 219/216
See application file for complete search history.

(56) References Cited

U.S. PATENT DOCUMENTS

| | | | | |
|---|---|---|---|---|
| 2003/0063931 | A1* | 4/2003 | Sanpei et al. | 399/328 |
| 2005/0141932 | A1* | 6/2005 | Sugiyama | 399/328 |
| 2006/0147231 | A1* | 7/2006 | Aruga et al. | 399/329 |
| 2008/0219723 | A1* | 9/2008 | Lee et al. | 399/329 |
| 2009/0162115 | A1* | 6/2009 | Kobayashi | 399/329 |
| 2011/0222930 | A1* | 9/2011 | Fujimoto et al. | 399/329 |

FOREIGN PATENT DOCUMENTS

| | | |
|---|---|---|
| JP | A-2005-165098 | 6/2005 |
| JP | A-2007-140562 | 6/2007 |

* cited by examiner

*Primary Examiner* — David Gray
*Assistant Examiner* — Sevan A Aydin
(74) *Attorney, Agent, or Firm* — Muncy, Geissler, Olds & Lowe, P.C.

(57) ABSTRACT

A fusing device includes a belt, a first stretching member contacting an inner circumference of the belt and stretching the belt tightly, a heating member having a heating element on the surface, a second stretching member having a heating member facing part that faces the heating member and a curved surface part that faces the belt, and stretching the belt tightly with the first stretching member.

32 Claims, 6 Drawing Sheets

FUSING DEVICE, PRINT DEVICE AND APPARATUS FOR HEATING BELT

CROSS REFERENCE TO RELATED APPLICATION

The present application is related to, claims priority from and incorporates by reference Japanese patent application No. 2010-129434, filed on Jun. 4, 2010.

TECHNICAL FIELD

The present invention relates to a fusing device for fusing developer onto a print medium, a print device that includes the fusing device, and an apparatus that is incorporated in a print device.

BACKGROUND

Conventional fusing devices includes a heater within a semi-cylindrical metallic body to transfer heat from the heater to a belt that is stretched and stringed to the metallic body, and the heated belt is pressed against the carried print medium to fuse the developer transferred onto the print medium by melting (see JP Patent Application Publication No. 2007-140562, paragraphs [0016] to [0022], FIG. 2).

However, obtaining high heat efficiency is difficult with conventional technology when the belt is heated by a heating member. Specifically, when a halogen lamp is the heating member, heating the belt to a prescribed temperature may require a long period of time. Furthermore, when using electromagnetic heat, the size of the device may increase.

An object of the present invention is to obtain high heating efficiency described above.

SUMMARY

For such on object, a fusing device disclosed in the application includes a belt; a first stretching member contacting an inner circumference of the belt and stretching the belt tightly; a heating member having a heating element on the surface; a second stretching member having a heating member facing part that faces the heating member and a curved surface part that faces the belt, and stretching the belt tightly with the first stretching member.

With the embodiments disclosed in the present application, high heating efficiency is realized.

DESCRIPTION OF THE PREFERRED EMBODIMENTS

Embodiments of the fusing device and print device according to the present invention are described hereinafter with reference to drawings.

First Embodiment

Figure 2:
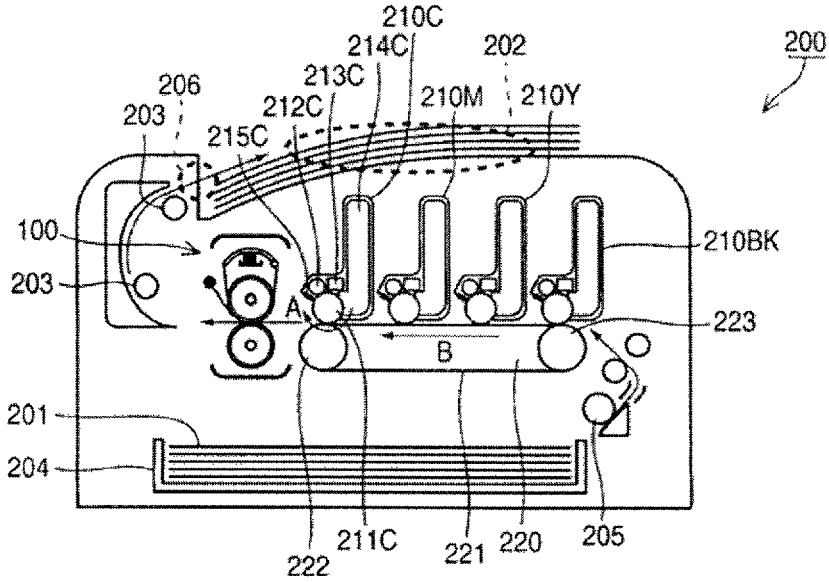
FIG. 2 is a schematic block diagram of a print device according to the first embodiment.

FIG. 2 is a schematic block diagram of a print device according to the first embodiment.

In FIG. 2, 200 is a commonly known print device such as a photocopier, printer, multifunction printer (MFP), or facsimile machine, which has a fusing device for fusing a developer image formed on a print medium by a heated belt. In addition, the print device 200 may be any type of print device as long as a fusing device that includes the present invention is provided. Furthermore, the present embodiment describes the print device 200 as a print device that forms a color image; however, this may also be a print device that forms a monochromatic image.

A print medium 201 is a medium such as recording sheet on which a developer image is formed and which is contained in a sheet feeding cassette 204. The print medium 201 contained in the sheet feeding cassette 204 is conveyed to each imaging device 210BK, 210Y, 210M, and 210C by a sheet feeding roller, not illustrated, to form the developer image in the transfer region.

A fusing device 100 uses a heated belt to fuse the developer image formed on the print medium in the transfer region, and the print medium where the developer image is fused by the fusing device 100 is ejected to a paper eject stacking part 202.

The imaging devices 210BK (BK: black), 210Y (Y: yellow), 210M (M: magenta), and 210C (C: cyan) are devices that form a developer image on the print medium using toner as developer for each color of black, yellow, magenta, and cyan respectively. The configuration of each imaging device 210 BK, 210Y, 210M or 210C is similar, and therefore, the configuration of the imaging device 210C is described below as a representative model.

The imaging device 210C has a photosensitive drum 211C as an electrostatic latent image carrier, and arranged in order in the rotating direction A (direction indicated by arrow A in the drawing) of the photosensitive drum 211C, a charging device 212C, an exposure device 213C, a developer supplying device 214C, and a cleaning device 215C. The configuration of the photosensitive drum 211C is a well known form to receive light irradiated from the exposure device 213C between the charging device 212C and the developer supplying device 214C. In addition, the electrostatic latent image carrier does not have to be a drum form, and it may be a belt form.

The print device 200 is provided with the imaging device 210 (210C, 210M, 210Y, and 210BK) to form an image in each color according to image information, a sheet feeding cassette 204 as the print medium feeding means to feed the print medium 201 into the transfer region of the belt type transferring device 220 that is arranged opposite to each of the imaging devices 210, and a registration roller 205 to feed a print medium carried from the print medium feeding means in accordance with the imaging timing by the imaging device 210.

The transferring device 220 is driven by rollers 222 and 223 that stretch an endless loop transferring medium 221 without slack. Further, a roller 203 carries the print medium and ejects the print medium, on which a developer image is fused by the fusing device 100 from the print medium ejection port 206 into the eject paper stacking part 202 as the region to stack the print medium after printing.

Figure 1:
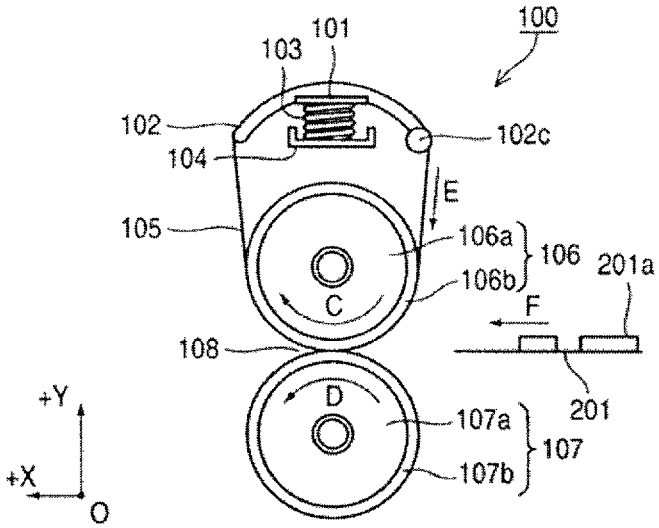
FIG. 1 is a side view of primary members of the fusing device according to the first embodiment.
Figure 3:
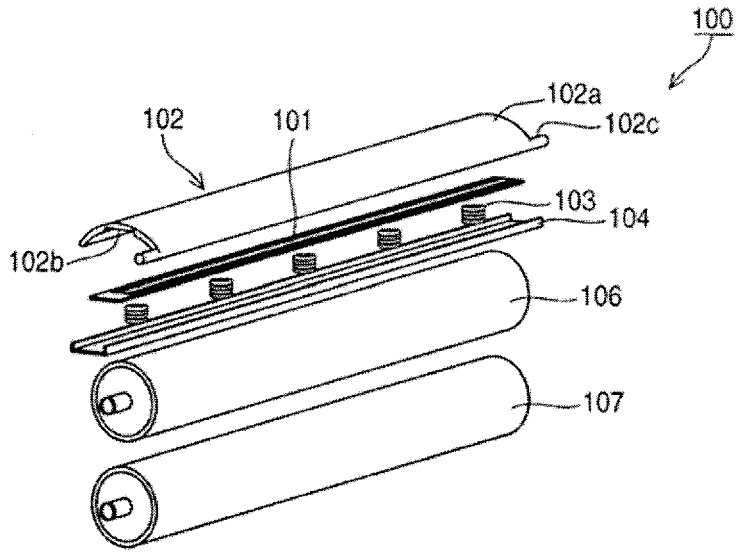
FIG. 3 is an exploded view of primary members of the fusing device according to the first embodiment.
Figure 4:
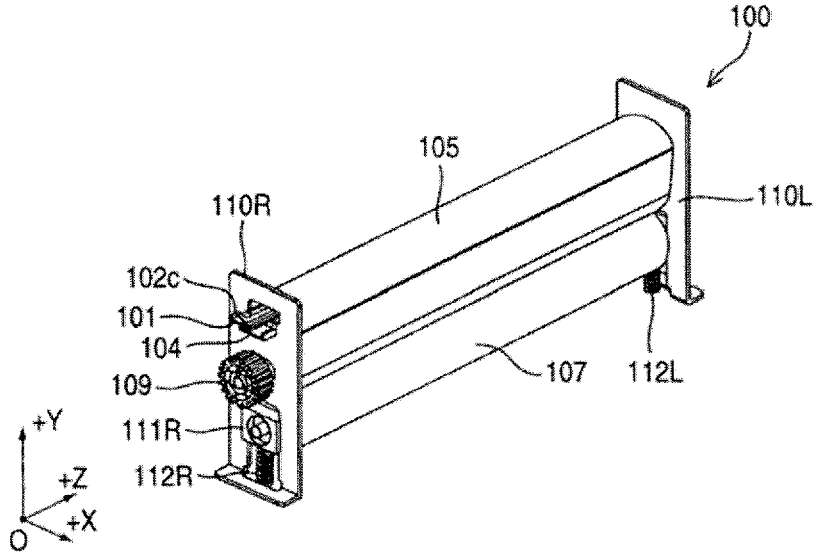
FIG. 4 is a perspective view of the fusing device according to the first embodiment.
Figure 5:
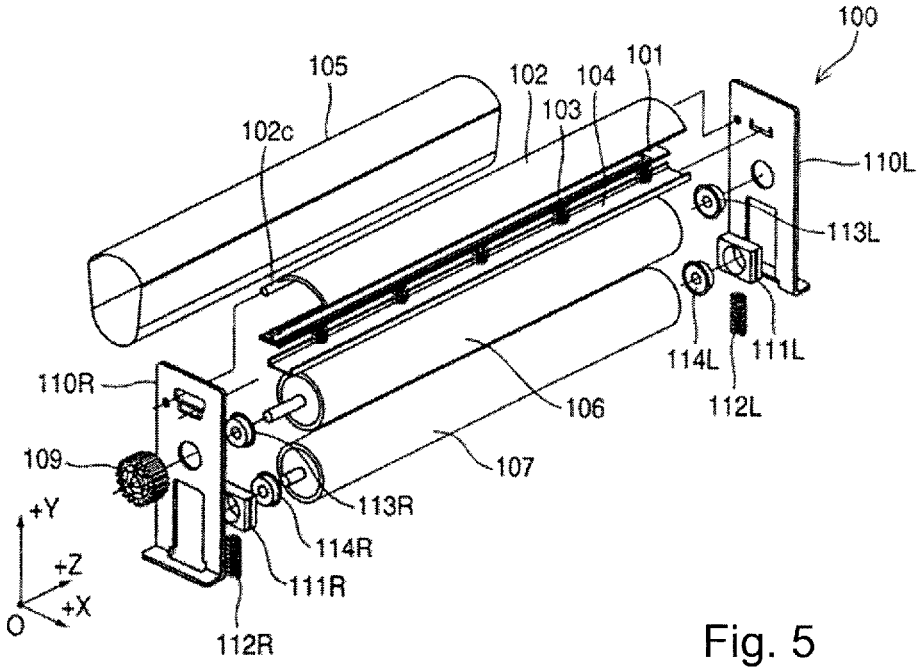
FIG. 5 is an exploded perspective view of the fusing device according to the first embodiment.

FIG. 1 is a side view of primary members of the fusing device according to the first embodiment. FIG. 3 is an exploded view of primary members of the fusing device according to the first embodiment. FIG. 4 is a perspective view of the fusing device according to the first embodiment. FIG. 5 is an exploded perspective view of the fusing device according to the first embodiment.

In FIG. 1 and FIG. 3, the fusing device 100 is configured as a heater 101 that is a heat generation member or a heating member; a metal guide 102 that is a heat transferring member, a second stretching member, or a guide member; springs 103 that are biasing members, pressure application members, or tension application members; a support member 104; a belt 105; a fusion roller 106 that is a first stretching member; and a pressure application roller 107.

Figure 6:
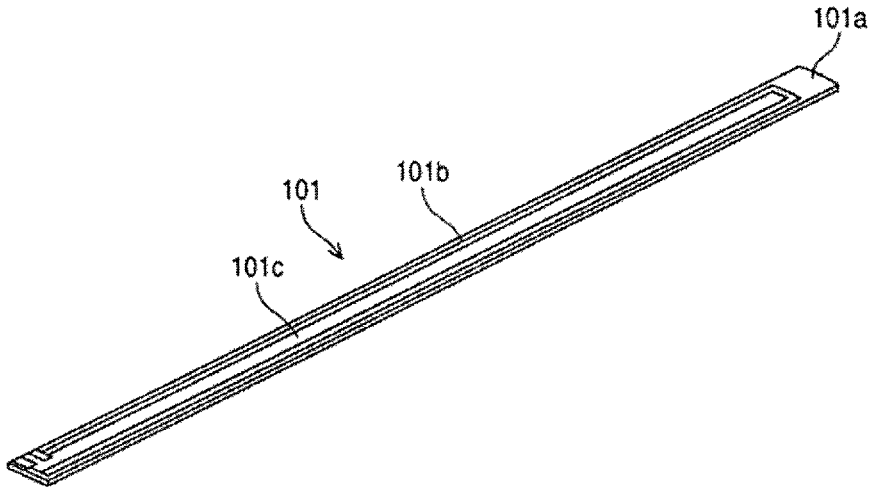
FIG. 6 is a perspective view of the heater according to the first embodiment.

The heater 101 is the heat generation member to heat the belt 105, and as shown in FIG. 6, is provided with a resistance wire 101*b* as a heating element at a plate like base material 101*a* having a planar part (planar shaped part) that is formed in a planar shape. Heat is generated by current flowing in the resistance wire 101*b*, and the heat generation member has a heating surface 101*c* formed in a planar shape. Further, an electrical power source and a control circuit are connected to the resistance wire 101*b* by a connector not illustrated in the drawings so as to distribute power at discretionary timing.

Figure 7A:
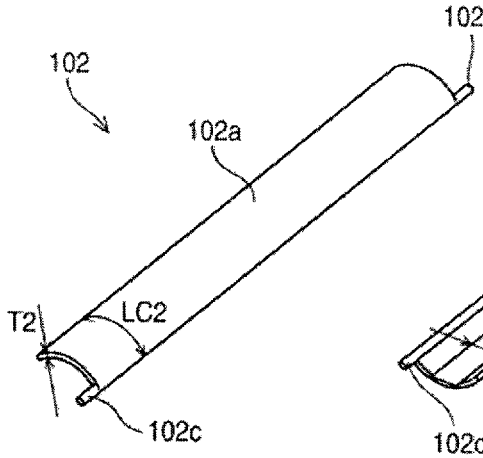
FIGS. 7A and 7B are perspective views of the metal guide according to the first embodiment.
Figure 7B:
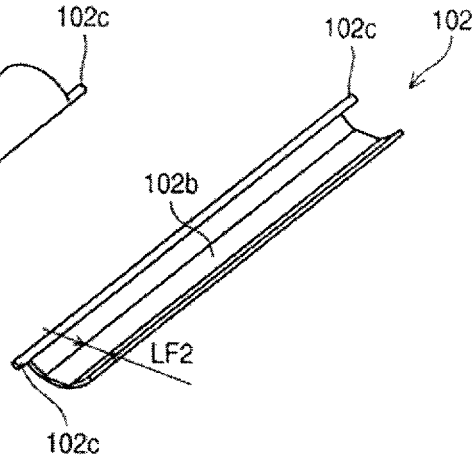

The metal guide 102 is a heat transferring member to transfer the heat of the heater 101 to the belt 105, and as shown in FIG. 7A, is provided with a guide surface 102*a* as a curved surface part formed with a convex curved surface that contacts the belt 105, and a heater facing part (or heating member facing part) 102*b* as a planar part (planar shaped part) formed in a planar shape that contacts the planar part of the heater 101 while being formed on the inner side (the center side) of the curved surface part which is the opposite side of the guide surface 102*a* as illustrated in FIG. 7B. In addition, FIG. 7A is a perspective view as viewed from the curved surface part side of the metal guide 102. FIG. 7B is a perspective view as viewed from the planar part side that is the opposite side.

The metal guide 102 has a pivot shaft 102*c* supported by pivot support points at both end parts by the holes in the side plates 110L and 110R (or retaining parts) illustrated in FIG. 4 and FIG. 5 which makes rotational displacement around the pivot shaft 102*c* possible. Further, the pivot shaft 102*c* is arranged farthest downstream of the guide surface 102*a* in the moving direction of the belt 105 that moves while contacting the guide surface 102*a* of the metal guide 102.

The springs 103 are biasing members for pressing the heater 101 against the metal guide 102 and are arranged between the heater 101 and the support member 104 that is attached to the side plates 110L and 110R illustrated in FIG. 4 and FIG. 5 and is fixed in the X-axis and Y-axis directions shown in the drawings. The springs 103 provide applied pressure to the heater 101 in the +Y direction (hereinafter the direction indicated by the arrow Y in the drawings) that is the direction perpendicular to the planar part of the metal guide 102 while also providing a rotational displacement force to the metal guide 102. Thereby, the planar part of the heater 101 is pressed against the heater facing part 102*b* that is the planar part of the metal guide 102 to contact without a gap, and the metal guide 102 being pressed by the heater 101 is rotationally displaced (pivoted) so that the guide surface 102*a* of the metal guide 102 contacts with the inner surface of the belt 105 and the belt 105 is stretched tightly. The spring 103 applies pressure to a planar surface of the metal guide 102 in a normal direction of the surface.

The belt 105 is provided with polyimide base material on the inner surface, an elastic layer made of silicone rubber on the outer circumferential layer of the base material, and a PFA tube with a surface on which toner is hard to adhere. Further, the belt 105 is configured to be an endless loop shape stretched tightly by the metal guide 102 and the fusion roller 106 and has the ability to rotationally move in the direction indicated by the arrow E in FIG. 1 by being driven by the rotation of the fusion roller 106. The belt 105 is heated by the heat of the heater 101 through the metal guide 102 that is in contact with the belt 105.

The fusion roller 106 as the first roller or the first nip forming member is provided with a metal core part 106*a* and an elastic layer 106*b*. Both end parts of the metal core part 106*a* are fixed and supported by the side plates 110L and 110R through the fusion roller rotation shaft bearings 113L and 113R illustrated in FIG. 5. Further, a fusion gear 109 is mounted at one side of the metal core part 106*a*, and the fusion roller 106 has the ability to rotationally move in the direction indicated by the arrow C in FIG. 1 by receiving motive power from a driving system not illustrated.

The pressure application roller 107 as the second roller or the second nip forming member is provided with a metal core part 107*a* and an elastic layer 107*b*. Both end parts of the metal core part 107*a* are supported by pressure application axis bearing support members 111R and 111L through the pressure application roller rotation shaft bearings 114L and 114R illustrated in FIG. 5, and have the ability for displacement in the Y axis direction in the drawing because the pressure application bearing support members 111R and 111L are attached to the side plates 110L and 110R.

Further, the pressure application bearing support members 111R and 111L illustrated in FIG. 4 and FIG. 5 receive a pressure application force in the +Y direction by pressure application members 112L and 112R, and a nipping region 108 is formed as an overlapping region of the elastic layer 107*b* of the pressure application roller 107 and the elastic layer 106*b* of the fusion roller 106 by pressing the elastic layer 107*b* of the pressure application roller 107 illustrated in FIG. 1 against the elastic layer 106*b* of the fusion roller 106 via the belt 105.

The pressure application roller 107 that is pressed against the fusion roller 106 via the belt 105 in the nipping region 108 is configured to rotate in the direction indicated by the arrow D in FIG. 1 when driven by the rotation of the fusion roller 106.

In addition, as illustrated in FIG. 4 and FIG. 5, the heater 101, metal guide 102, support member 104, fusion roller 106, and pressure application roller 107 are elongated members extending in the Z axis direction that is perpendicular to the direction of the rotational movement of the belt 105, and the print medium where the developer is transferred is carried in the +X direction.

Furthermore, a plurality of springs 103 (5 springs in the present embodiment) are provided between the heater 101 and the support member 104, and each has the same pressure application force; however, when considering slack in the center part (center part in the Z axis direction perpendicular to the direction of the rotational movement of the belt 105) of the metal guide 102 and the support member 104, the pressure application force of the spring 103 arranged at the center part may be stronger than the pressure application force of the springs 103 arranged at both side parts.

The effect of the configuration given above is described below based on FIG. 1 and FIG. 2.

When power is turned on to the print device 200 and commonly known operations are performed to start image formation by an operator, the print device 200 feeds the print medium 201 contained in the sheet feeding cassette 204, and the print medium 201 is carried to the transferring device 220 by the registration roller 205.

At that time, in the imaging device 210C, the photosensitive drum 211C is charged uniformly by the charging device 212C with the rotation of the photosensitive drum 211C in the direction indicated by the arrow A in FIG. 2. Subsequently, an electrostatic latent image is formed according to image information by a light irradiated from the exposure device, and this electrostatic latent image is developed by the developing device 214C to form a developer image on the surface thereof.

The developer image formed on the photosensitive drum 211C is transferred onto the print medium 201 carried in the direction indicated by the arrow B in FIG. 2 on the transferring device 220. After the transfer, the residual developer on the photosensitive drum 211C is scraped off by the cleaning device 215C to clean the surface of the photosensitive drum 211C. Thereafter, the next charge is conducted.

While the recording medium on which cyan developer is transferred in such manner is carried in the direction indicated by the arrow B in the drawing by the transferring device 220, each color of the respective developers of magenta, yellow, and black is appropriately transferred by the imaging devices 210M, 210Y and 210BK that perform the same process as the previously described imaging process performed by the imaging device 210C. After all of the developers necessary for image forming are transferred, the recording medium is carried to the fusing device 100 from the transferring device 220.

When fusing the developer transferred onto the print medium, the fusing device 100 applies electric current to a resistance wire 101*b* illustrated in FIG. 6 of the heater 101 by a control device not illustrated to cause the heater 101 to generate heat so as to have a sufficient heat quantity to perform thermal compression bonding on the developer image formed on the print medium.

The planar part of the heater 101 biased by the spring 103 contacts the heater facing part 102*b* that is the planar part of the metal guide 102 illustrated in FIG. 3 at co-planar surfaces without a gap. Accordingly, the heat generated by the heater 101 can be transferred efficiently to the metal guide 102 via the heater facing part 102*b*.

Further, because a plurality of springs 103 are arranged between the heater 101 and the support member 104, the entire planar part of the heater 101 contacts without a gap with the entire heater facing part 102*b* of the metal guide 102, and the heat generated by the heater 101 can be transferred efficiently to the metal guide 102 via the heater facing part 102*b*.

Furthermore, by providing a substance having desired heat conductivity, such as deformable semi-solid grease, with an air gap (or space) between the planar part of the heater 101 and the heater facing part 102*b* that is the planar part of the metal guide 102, the gap can be reduced and the heat generated by the heater 101 can be transferred more efficiently to the metal guide 102 via the heater facing part 102*b*. It is also referred that these planar parts of the heater 101 and the heater facing part 102*b* may be coated with a substance having a desired thermal conductivity. An example of the grease may be silicone oil mixed with metal powder (e.g., zinc or silver powder) to improve heat transfer property.

The fusion roller 106 rotationally moves in the direction indicated by the arrow C in FIG. 1 by giving motive power to the fusion gear 109 illustrated in FIG. 4 by a driving system not illustrated while at the same time the heater 101 generates heat. Meanwhile, the belt 105 and the pressure application roller 107 are also driven by the rotation of the fusion roller 106, and the belt 105 starts the rotational movement in the direction indicated by the arrow E in FIG. 1 and the pressure application roller 107 starts the rotational movement in the direction indicated by the arrow D in FIG. 1.

Here, the belt 105 is stretched tightly by the pressure application force provided by the springs 103, the fusion roller 106 fixed at the side plates, and the guide surface 102*a* of the metal guide 102 illustrated in FIG. 3, and the contact surface of the metal guide 102 and the belt 105 are the curved-shape guide surface 102*a* and thus the belt 105 contacts with the guide surface 102*a* of the metal guide 102 without a gap.

When the belt 105 that receives rotational movement by the fusion roller 106 passes over the guide surface 102*a* that is the contact surface with the metal guide 102, the heat generated by the heater 101 is transferred efficiently. After a sufficient quantity of heat is supplied to perform thermal compression bonding of the developer image, the print medium 201 is carried to the nipping region 108 to perform thermal compression bonding of the developer image 201*a* formed on the print medium 201 that is carried in the direction indicated by the arrow F in FIG. 1 in the nipping region 108.

Further, because the pivot shaft 102*c* of the metal guide 102 is arranged farthest downstream of the metal guide 102 in the rotation direction of the belt 105 and is near the advancing side of the print medium in the nipping region 108, even if the metal guide 102 vibrates, the position of the pivot shaft 102*c* is not displaced. Accordingly, the position of the advancing side of the print medium in the nipping region 108 is not displaced, so the print medium can be carried in a stable state.

Furthermore, the fusing device 100 has a feature to suppress variance with the passage of time, because the nipping region 108 is formed with the fusion roller 106 and the pressure application roller 107 that have the ability to rotate, the drive torque can be reduced and friction of the sliding members can be reduced.

The print medium 201 that is bonded by thermal compression in the nipping region 108 in such manner is carried to the print medium stacking part 202 via the print medium eject port 206 by the medium carrying roller 203.

The configurations of the heater 101, metal guide 102, spring 103, belt 105, fusion roller 106, and pressure application roller 107 of the fusing device 100 in the present embodiment are described below.

For the heater 101, the resistance wire 101*b* is layered on a stainless steel (SUS) substrate 101*a* having a long direction length of 350 mm, a short direction width of 10 mm, and a thickness of 1 mm illustrated in FIG. 6, and the output of the resistance wire 101*b* is 1000 W.

For the metal guide 102, the material is an extruded type aluminum material A6063, the thickness T2 is a part of a 1 mm cylindrical shape as illustrated in FIG. 7, the curvature radius R of the guide surface 102*a* is 25 mm, the width LC2 is 30 mm, and the width LF2 of the heater facing part 102*b* is 10.2 mm.

For the springs 103, the material is stainless steel and a pressure application force of 3 Kgf is applied to the heater 101 in the +Y direction in FIG. 1. Further, the support member 104 is a metal plate with durable rigidity.

The belt 105 has an inner diameter of ϕ40 mm and has a polyimide substrate with a 0.1 mm thickness at the inner surface, an elastic layer made of silicone rubber is formed with a 0.2 mm thickness at the outer circumferential layer, and the PFA tube layer is further provided at the outer circumference.

For the fusion roller 106, the outer diameter is ϕ25 mm, and the elastic layer 106*b* is silicone sponge with a 2 mm thickness.

For the pressure application roller, the outer diameter is ϕ25 mm, the elastic layer 107*b* is silicone rubber with a 2 mm thickness, and the outer circumference layer is configured of the PFA tube. Further, both end parts of the metal core part 107*a* of the pressure application roller 107 are supported by the pressure application axis bearing support members 111L and 111R as illustrated in FIG. 4, and the pressure application axis bearing support members 111L and 111R are receiving 20 Kgf of pressure application force in the +Y direction by the pressure application members 112L and 112R.

In the configuration described above, at the same time that electric current is introduced into the resistance wire 101*b* of the heater 101, rotation movement is provided to the fusion roller 106. When the fusion roller 106 rotates, the belt 105 contacting the guide surface 102*a* of the metal guide 102 rotates driven by the rotation of the fusion roller 106.

The heat generated by the heater 101 is transferred effectively to the belt 105 from the guide surface 102*a* of the metal guide 102, and fusion of the favorable developer at a speed of approximately 30 pages per minute (ppm) with A4 transverse feed in the nipping region 108 enables a rise time of about 15 seconds after introducing power into the resistance wire 101*b* of the heater 101 which is about ¼ the rise time compared to using a halogen lamp (about 60 seconds).

Further, using an aluminum material that has high heat conductivity with a small heat capacity for the metal guide 102 suppresses temperature irregularities in the long direction of the fusing device 100 allowing the fusion of the developer to be stabilized. Also, because the contact surface with the belt 105 is the metal guide 102 made of aluminum, and the heater 101 does not contact the belt 105, there is no risk of causing damage to the heater 101 due to friction.

As described above, by providing a heater having a planar part and a metal guide having a heater facing part of a planar shape that contacts the planar part of the heater in the inside surface that is the opposing surface of the curved guide surface, and by applying heat to the belt contacting the guide surface of the metal guide, the rise time of the fusing device can be shortened with the simple configuration without increasing the size of the device while being able to realize a fusing device with a stable temperature distribution.

Figure 8:
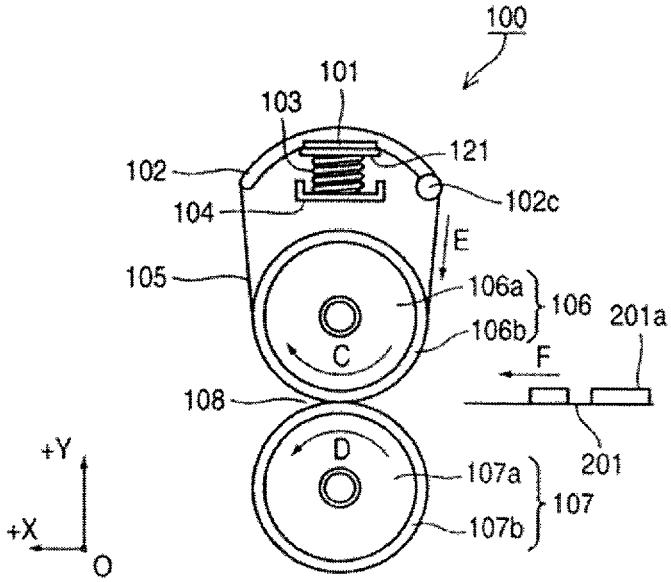
FIG. 8 is a side view of primary members of the fusing device according to a modified example of the first embodiment.

Furthermore, as a modified example of the present embodiment, a heat insulation member 121 formed of a ceramic material or the like with excellent heat-insulating properties, rigidity, as well as heat-resistance properties may be provided between the heater 101 and the springs 103 as illustrated in FIG. 8. With such a configuration, transferring heat of the heater 101 to the springs 103 and the support member 104 can be suppressed and the heat of the heater 101 can be transferred to the metal guide 102 more efficiently.

As described above, the first embodiment achieves the effects with a simple configuration, the effects that the rise time of the fusing device can be reduced and that the temperature distribution of the fusing device can be stabilized by providing a heater having a planar part and a metal guide having a planar shape of the heater facing part contacting the planar part of the heater in the inside surface that is the opposing surface of a curved guide surface.

Second Embodiment

Figure 9:
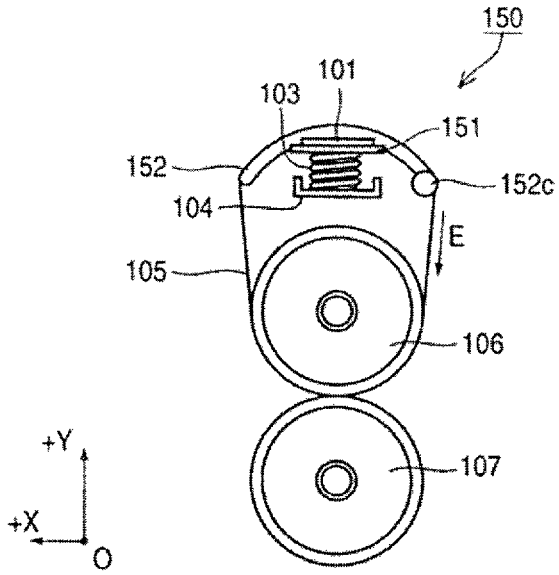
FIG. 9 is a side view of primary members of the fusing device according to the second embodiment.
Figure 10:
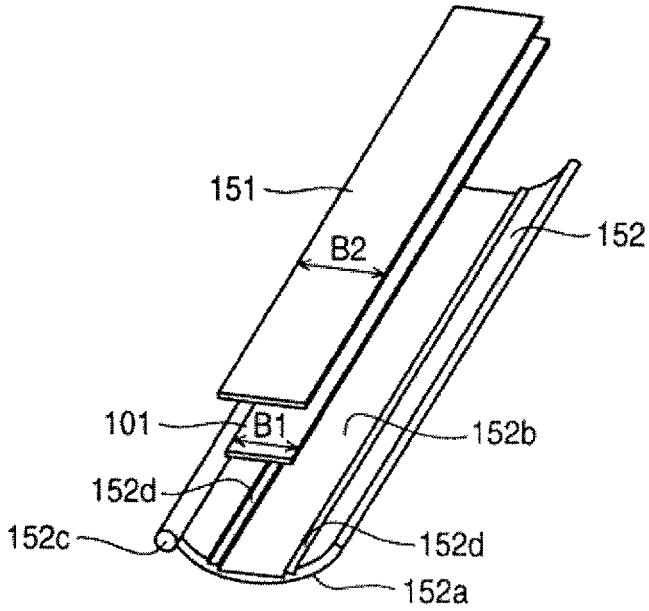
FIG. 10 is a perspective view of the thermal diffusion member and the metal guide according to the second embodiment.

FIG. 9 is a side view of the primary member of the fusing device according to the second embodiment. FIG. 10 is a perspective view of the thermal diffusion member and the metal guide according to the second embodiment. In addition, the same parts as the first embodiment described above are given the same numerical codes and the descriptions thereof will be omitted.

In FIG. 9, a fusing device 150 is provided with a thermal diffusion member 151 between the heater 101 and the springs 103. The thermal diffusion member 151 is an aluminum material with high heat conductivity, and as illustrated in FIG. 10, the width B2 (lateral width) of the short direction (direction or moving direction of the belt 105 in FIG. 9) is longer than the width B1 of the short direction of the heater 101. In other words, it is formed so as to have the relationship that the width B2>width B1. Moreover, approximately 150 W/m° C. or more is preferable for the above-described heat conductivity. Aluminum, silver, gold and copper are examples of materials having high heat conductivity. In the present embodiment, aluminum with heat conductivity of 236 W/m° C. is used.

Further, a heater facing part 152*b* contacting the heater 101 as illustrated in FIG. 10 and a contact planar part 152*d* contacting the thermal diffusion member 151 are formed at the metal guide 152 that corresponds to the metal guide (102) of the first embodiment. In addition, the configurations of the guide surface 152*a* and the pivot shaft 152*c* are the same with the configurations of the guide surface (102*a*) and the pivot shaft (102*c*).

A description will be given of the effect of the configuration described above.

The operation until the heater 101 starts to generate heat is the same as the first embodiment, so the description thereof will be omitted.

Figure 11:
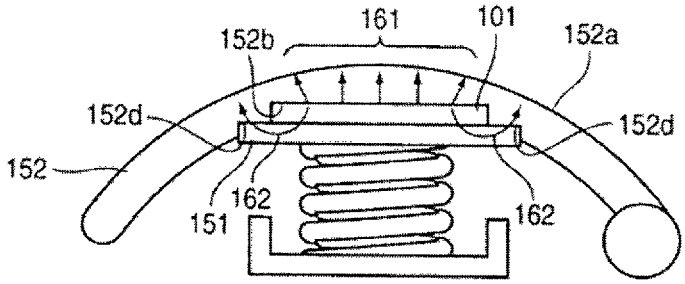
FIG. 11 is an explanatory diagram illustrating the flow of heat transfer from the heater according to the second embodiment.

When the heater 101 starts generating heat, the heat generated by the heater 101 is transferred to a metal guide 152 via two routes: a route 161 transferring to the metal guide 152 via the contact surface with the heater 101 and the heater facing part 152*b* of the metal guide 152; and a route 162 transferring to the metal guide 152 via the contact surface of a thermal diffusion member 151 and a contact planar part 152*d* of the metal guide after being transferred to the thermal diffusion member 151 via the contact surface of the heater 101 and the thermal diffusion member 151 as illustrated in FIG. 11.

The heat generated by the heater 101 in such manner is transferred to the metal guide 152 more efficiently than the first embodiment via both routes with the contact surface with the metal guide 152 and the contact surface with the thermal diffusion member 151, and the heat that is transferred to the metal guide 152 is transferred to the belt 105 contacting the metal guide 152.

In addition, other functions are the same as the first embodiment, so the descriptions thereof will be omitted.

Figure 12:
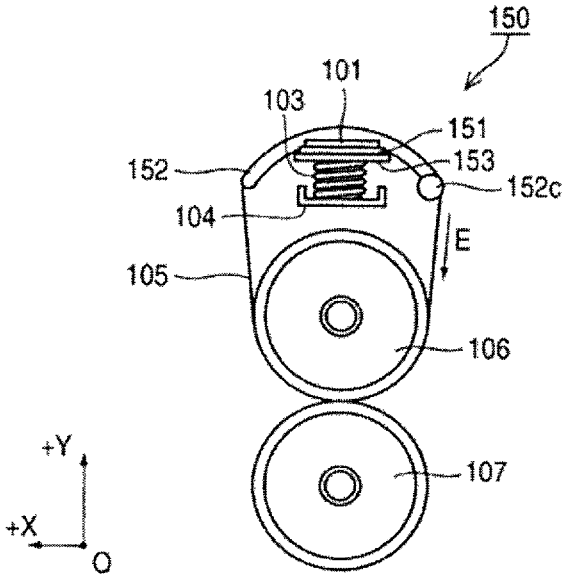
FIG. 12 is a side view of the primary member of the fusing device according to a modified example of the second embodiment.

Further, as a modified example of the present embodiment, a heat insulation member 153 formed of a ceramic material or the like with excellent heat-insulating properties, rigidity, as well as heat-resistance properties may be provided between the thermal diffusion member 151 and the springs 103 as illustrated in FIG. 12. By constituting in such manner, transferring heat of the thermal diffusion member 151 to the springs 103 and the support member 104 can be suppressed and the heat of the heater 101 can be transferred to the metal guide 102 more efficiently.

As described above, the second embodiment achieves the effect that the rise time of the fusing device can be further reduced compared to the first embodiment and the temperature distribution of the fusing device can be further stabilized by providing a thermal diffusion member in which the width of the short direction is longer than the width of the short direction of the heater between the heater and the springs to form a surface where the thermal diffusion member and the metal guide contact, and adding a surface where the heater and the metal guide directly contact so as to transfer the heat generated by the heater to the metal guide via the surface contacting the thermal diffusion member.

In addition, the fusion roller and the pressure application roller form the nipping region in the first and second embodiments; however, the nipping region may be formed by using a pressure application pad instead of the pressure application roller or by using a plurality of parts of a roller and pressure application pad.

Further, the first and second embodiments use a belt made of a polyimide base material; however, a belt made of a metal base material with excellent heat transference may also be used.

Furthermore, the first and second embodiments use a heater made of an SUS base plate; however, a heater made of ceramic may also be use.

Moreover, the first and second embodiments drive the fusing roller to provide the rotation movement to the belt; however, driving the pressure application roller or driving both the fusing roller and the pressure application roller are also possible.

Even furthermore, in the first and second embodiments, applying pressure to the metal guide of the heater and the stretching the belt tightly by the metal guide are carried out by one pressure application member; however, applying pressure to the metal guide of the heater and the stretching the belt tightly by the metal guide are also possible to be carried out by a plurality of the pressure application members.

What is claimed is:

1. A fusing device, comprising:

a belt;

a first stretching member contacting an inner circumference of the belt and stretching the belt tightly;

a heating member having a heating element on a flat surface;

a biasing member pressing a second stretching member toward the belt;

a thermal diffusion member arranged between the heating member and the biasing member; and the second stretching member having a first flat part that faces the heating member, a second flat part that is formed outside a lateral width of the first flat part and that faces a part of the thermal diffusion member, and a curved belt facing part that faces the belt, and stretching the belt tightly with the first stretching member, wherein the first flat part faces the heating member at a center portion of the second stretching member that is on the direct opposite side of the curved belt facing part that contacts the inner circumference of the belt, wherein the heating member does not contact the belt, and wherein the heating member is positioned by contacting the first flat part, and the thermal diffusion member is positioned by contacting the heating member and the second flat part.

2. The fusing device according to claim 1, wherein the biasing member includes one end fixed to a support member and another end pressing the heating member toward the second stretching member.

3. The fusing device according to claim 2, wherein the first flat part has a planar surface, and the biasing member is arranged to apply bias in a normal direction with respect to the planar surface of the first flat part.

4. The fusing device according to claim 2, further comprising:

a heat insulation member arranged between the heating member and the biasing member.

5. The fusing device according to claim 2, wherein a plurality of the biasing members are arranged in a direction perpendicular to the direction of a rotational movement of the belt.

6. The fusing device according to claim 2, further comprising:

a heat insulation member arranged between the biasing member and the thermal diffusion member.

7. The fusing device according to claim 2, wherein a lateral width of the thermal diffusion member is longer than a lateral width of the heating member.

8. The fusing device according to claim 2, wherein the thermal diffusion member has a heat conductivity of 150 W/m° C. or more.

9. The fusing device according to claim 1, further comprising:

retaining portions retaining the first stretching member and the second stretching member.

10. The fusing device according to claim 9, further comprising:

a support member fixed at one of the retaining portions, wherein the biasing member is arranged at the support member to press the second stretching member toward the belt.

11. The fusing device according to claim 10, wherein the biasing member presses the heating member from a side opposite to a heating surface of the heating member.

12. The fusing device according to claim 1, wherein the heating member has a heating surface, and the heating surface is substantially planar.

13. The fusing device according to claim 1, wherein the first flat part is substantially planar so that the first flat part is attached to a heating surface of the heating member without a gap therebetween.

14. An image forming device, comprising:

an image forming part that forms an image on a recording medium with developer; and the fusing device according to claim 1 that fuses a developer image formed by the image forming part onto the recording medium.

15. The fusing device according to claim 1, wherein the heating element is configured to contact the first flat part.

16. The fusing device according to claim 1, wherein the second stretching member is formed between the heating element and the belt such that the second stretching member prevents the heating element from contacting the belt.

17. The fusing device according to claim 1, wherein the second stretching member is movable relative to the belt to tightly stretch the belt.

18. The fusion device according to claim 1, wherein the second stretching member includes a first recess having the first flat part and a second recess having the second flat part with a longer lateral width than that of the first recess, the heating member is disposed in the first recess, and the thermal dissipation member is disposed in the second recess.

19. A fusing device, comprising:

a belt;

a first stretching member configured to contact an inner circumference of the belt and configured to stretch the belt tightly;

a heating member having a heating element on a surface;

a second stretching member having a heating member facing part that faces the heating member and a curved surface part that faces the belt, and the second stretching member being configured to stretch the belt tightly with the first stretching member; and a biasing member configured to press the second stretching member toward the belt, wherein the biasing member includes one end fixed to a support member and another end pressing the heating member toward the second stretching member, wherein the biasing member is plural and the biasing members are arranged in a direction perpendicular to the direction of a rotational movement of the belt, and wherein pressure application forces of the biasing members applied to a center part of the second stretching member with respect to direction perpendicular to the rotational direction of the belt are stronger than pressure application forces of the biasing members applied to both side parts of the second stretching member.

20. The fusing device according to claim 19, wherein the second stretching member is movable relative to the belt to tightly stretch the belt.

21. A fusing device, comprising:

a belt;

a first stretching member contacting an inner circumference of the belt and configured to stretch the belt tightly;

a heating member having a heating element on a surface;

a second stretching member having a heating member facing part that faces the heating member and a curved surface part that faces the belt, the second stretching member being configured to stretch the belt tightly with the first stretching member; and retaining portions retaining the first stretching member and the second stretching member, wherein the second stretching member includes a pivot shaft at a downstream side of the rotational direction of the belt, and the pivot shaft is rotatably supported by the retaining portions.

22. An apparatus for heating a belt of a fusing device, comprising:

a heating member including a heating element formed on a planar heating surface; and a metal guide for transferring heat to the belt, the metal guide including a curved outer surface for contacting and tightly stretching the belt and a planar inner surface that is co-planar, and in contact, with the planar heating surface of the heating member to transfer heat from the heating member to the curved outer surface and thereby heat the belt, wherein the planar inner surface contacts the planar heating surface at a center portion of the metal guide where the planar inner surface is on the direct opposite side of the metal guide as the curved outer surface, and the metal guide is movable relative to the belt to tightly stretch the belt.

23. The apparatus according to claim 22, further comprising a heat conductive substance on at least one of the planar heating surface of the heating member and the planar inner surface of the metal guide to reduce air gaps between the planar heating surface of the heating member and the planar inner surface of the metal guide.

24. The apparatus according to claim 23, wherein the heat conductive substance has a heat conductivity of 150 W/m° C. or more.

25. The apparatus according to claim 22, wherein the curved outer surface is defined by a convex curve with respect to the belt.

26. The apparatus according to claim 22, wherein the curved outer surface of the metal guide is in contact with an inner circumferential surface of the belt, the metal guide forms a recess having a flat portion that includes the planar inner surface, and the heating member is disposed in the recess.

27. A fusion device, comprising:

a belt;

a support member positioned to contact an inner circumference of the belt;

a heating member including a heating element, and positioned to heat the belt;

a biasing member biasing the heating member toward the belt; and a thermal diffusion member arranged between the heating member and the biasing member; wherein the support member includes a first flat part that faces the heating member, a second flat part that is formed outside a lateral width of the first flat part and that faces a part of the thermal dissipation member, and a curved part that contacts the inner circumference of the belt, wherein the first flat part contacts the heating member at a center portion of the support member where the first flat part is on the direct opposite side of the support member as the curved part, and wherein the heating member is positioned by contacting the first flat part, and the thermal dissipation member is positioned by contacting the heating member and the second flat part.

28. The fusion device of claim 27, further comprising a heat blocking member between the heating member and the biasing member.

29. The fusion device of claim 27, wherein the biasing member is plural, and the biasing members are provided in a direction perpendicular to a rotational direction of the belt, and a biasing force of the biasing members at a center part of the belt in a direction perpendicular to the rotational direction of the belt is greater than a biasing force of the biasing members at end parts of the belt.

30. The fusion device of claim 22, wherein the curved part is formed to form a projection shape projecting toward a side of the belt.

31. The fusion device of claim 27, wherein the curved part of the support member is in contact with an inner circumferential surface of the belt, the support member forms a first recess having the first flat part and a second recess having the second flat part, the heating member is disposed in the first recess, and the thermal dissipation member is disposed in the second recess.

32. The fusion device according to claim 27, wherein the support member is movable relative to the belt to tightly stretch the belt.

* * * * *